US010783864B2

(12) United States Patent
Mamou-Mani

(10) Patent No.: US 10,783,864 B2
(45) Date of Patent: Sep. 22, 2020

(54) ACOUSTIC MUSICAL INSTRUMENT ENHANCED WITH FEEDBACK AND INJECTION ACTUATORS

(71) Applicant: HYVIBE, Paris (FR)

(72) Inventor: Adrien Mamou-Mani, Paris (FR)

(73) Assignee: HYVIBE, Paris (FR)

( * ) Notice: Subject to any disclaimer, the term of this patent is extended or adjusted under 35 U.S.C. 154(b) by 0 days.

(21) Appl. No.: 16/486,677

(22) PCT Filed: Oct. 10, 2017

(86) PCT No.: PCT/FR2017/052778

§ 371 (c)(1),
(2) Date: Aug. 16, 2019

(87) PCT Pub. No.: WO2018/154188

PCT Pub. Date: Aug. 30, 2018

(65) Prior Publication Data

US 2020/0058278 A1 Feb. 20, 2020

(30) Foreign Application Priority Data

Feb. 22, 2017 (FR) ..... 17 51403

(51) Int. Cl.
*G10H 1/045* (2006.01)
*G10H 1/46* (2006.01)
(Continued)

(52) U.S. Cl.
CPC ..... *G10H 1/045* (2013.01); *G10H 1/46* (2013.01); *G10H 3/22* (2013.01); *G10H 3/26* (2013.01);
(Continued)

(58) Field of Classification Search
CPC ..... G10H 1/045; G10H 1/46; G10H 3/22; G10H 3/26; G10H 2210/265; G10H 2220/525
(Continued)

(56) References Cited

U.S. PATENT DOCUMENTS 5,796,920 A * 8/1998 Hyland ..... G05B 13/027 706/20
6,320,113 B1 * 11/2001 Griffin ..... G10D 3/00 84/738
(Continued)

FOREIGN PATENT DOCUMENTS

JP 2015-146030 A 8/2015
WO 97/12359 A1 4/1997
(Continued)

*Primary Examiner* — David S Warren
*Assistant Examiner* — Christina M Schreiber
(74) *Attorney, Agent, or Firm* — Faegre Drinker Biddle & Reath LLP

(57) ABSTRACT

Processing implemented by computer means of sound data output by at least one sensor and activation of at least one actuator of an acoustically radiating structure. The sensor senses an acoustic signal output by the vibration of the radiating structure. The radiating structure bears at least one actuator controlled by the computer means and is thus involved in the vibration of the radiating structure. In particular, the method comprises the steps of: a) measuring a transfer function of the actuator, radiating structure and sensor assembly, b) controlling activation of the actuator so as to make the radiating structure vibrate, according to a selected setpoint: taking account of the transfer function measured, and taking account of the acoustic signal sensed by the sensor in feedback mode.

12 Claims, 6 Drawing Sheets

(51) Int. Cl.
*G10H 3/22* (2006.01)
*G10H 3/26* (2006.01)

(52) U.S. Cl.
CPC . *G10H 2210/265* (2013.01); *G10H 2220/525* (2013.01)

(58) Field of Classification Search
USPC ..... 84/659
See application file for complete search history.

(56) References Cited

U.S. PATENT DOCUMENTS

| | | | | |
|---|---|---|---|---|
| 6,449,369 | B1 * | 9/2002 | Carme | H04R 1/1008 381/71.12 |
| 2002/0126852 | A1 * | 9/2002 | Kashani | G10K 11/178 381/71.4 |
| 2020/0058278 | A1 * | 2/2020 | Mamou-Mami | G10H 1/46 |

FOREIGN PATENT DOCUMENTS

| | | | | |
|---|---|---|---|---|
| WO | WO-9712359 | A1 * | 4/1997 | H04R 3/005 |
| WO | 2014/076144 | A1 | 5/2014 | |
| WO | WO-2014076144 | A1 * | 5/2014 | G10H 1/22 |
| WO | 2016/209143 | A1 | 12/2016 | |
| WO | WO-2016209143 | A1 * | 12/2016 | G10H 3/26 |

* cited by examiner

ACOUSTIC MUSICAL INSTRUMENT ENHANCED WITH FEEDBACK AND INJECTION ACTUATORS

CROSS-REFERENCE TO RELATED APPLICATIONS

This application is the U.S. national phase of the International Patent Application No. PCT/FR2017/052778 filed Oct. 10, 2017, which claims the benefit of French Application No. 17 51403 filed Feb. 22, 2017, the entire content of which is incorporated herein by reference.

FIELD

The present disclosure relates to processing of sound data sensed on a musical instrument with an acoustically radiating structure. More specifically, it is envisaged to supply one of more actuators of the radiating structure of the instrument with a signal developed from the sensed and processed sound data, and this in view of enhancing the vibratory properties and notably the sound output by the instrument with desired sound effects (delay, reverberation, distortion, equalization, etc.).

BACKGROUND

For example, string musical instruments comprise a radiating structure (sound board and optionally sound box) coupled to a bridge bearing strings. Therefore, it is proposed within the scope of the present disclosure to make the radiating structure resonate with a specific effect, further the playing by the musician. For example, in the case of a delay, the musician plays a note that the radiating structure amplifies and diffuses, but furthermore, one or more actuators acting on the radiating structure subsequently apply a vibration to the structure to replay said note at regular time intervals with a reduction in amplitude in order to simulate the delay effect.

Said approach is different from the case of the effects conventionally applied by typically playing on an electric guitar connected to an amplifier via a cable (or "jack"). With reference to FIG. 1 illustrating said case, one or more sensors MIC mounted on the guitar GUI sense the vibration signal of the strings and said signal supplies a device EF applying a selected transformation of the signal (delay, reverberation, distortion, equalization, "phaser" type or slower "flanger" type phase change, a slight change in frequency with "chorus" type or clearer "octaver" type mixing, a "tremolo" type amplitude modulation, a sound amplitude change: dynamically ("sustain" or "compression" type or not, or others). Said device EF (commonly known as "effects pedal") is conventionally connected to an amplifier AMP that amplifies electronically and makes the sound signal transformed by the effects pedal EF radiate.

In the case of the approach within the meaning of the present disclosure, the radiating structure of the instrument, same (typically the sound box CAI of a guitar for example), is used as a "diffuser" or "loudspeaker" of the sound signal transformed by an "effects pedal" type device DEV.

More specifically in the example in FIG. 2, one or more sensors MIC are mounted on the sound box of the guitar (for example at the sound hole). Said sensor(s) sense(s) the sound vibrations of the radiating structure. The digital signal corresponding to said acoustic signal is emitted as input E of a device DEV applying the desired effect(s) and controlling, by the output S thereof, the actuators ACT applied against the sound box CAI so as to make the box vibrate according to the effects selected by the user of the device DEV.

In general, in the context of FIG. 2, the electronic transformation of the sound radiated by a string instrument consisted hitherto of:

Integrating sensors and actuators into said instruments
Applying processing on the signals sensed
and sending back said signals to the actuators.

The sound radiated by the instrument is thus the sum of the acoustic sound played by the musician and of the transformations thereof by the device DEV (without needing to pass the signal sensed into an amplification chain, as conventionally performed and illustrated in FIG. 1).

The transformations thus applied are generally digital audio effects (reverberation (or "reverb"), chorus, distortion, equalization) injected as "feedforward", that is to say processing does not take into account the feedback emitted by the actuators on the sensors.

The transformations applied with said techniques do not obtain the desired effects.

The digital audio effects induce instabilities (Larsen effect). Thus, an undesired frequency is heard superimposing the desired signal.

The radiated sound has a poor quality, for example compared to another instrument or to same obtained by a conventional amplification chain of the type illustrated in FIG. 1.

Said two defects arise from the fact that the features of the radiating structure and/or of the coupling thereof with the excitation by the strings are not taken into account. Indeed, the vibratory features of the radiating structure transform the signals emitted by the actuators unequally according to the frequencies. This is due notably to the regions of the box where the resonance modes induce amplitude modifications from one frequency to another. Said unequal feature is imposed by the manufacturer of the instrument and is indicative of the quality of the instrument when same is played by plucking the strings. On the other hand, when the excitation is carried out by the actuators, this induces an unequal sound quality according to the notes played. In addition, the significant coupling between the strings and the box at some frequencies induces a strong feedback on the sensors after emission by the actuators. Said feedback changes the frequencies and dampings of the resonances of the box. The fact of not taking account of said feedback is thus a source of error and of instability of the sounds targeted.

The present disclosure improves the situation.

SUMMARY

To this end, the disclosure proposes a method implemented by computer means, processing of sound data output by at least one sensor and activation of at least one actuator of an acoustically radiating structure. The sensor senses an acoustic signal output by the vibration of the radiating structure. The radiating structure bears at least one actuator controlled by the aforementioned computer means and being involved in the vibration of the radiating structure.

In particular, the method comprises:

a) measuring a transfer function of the actuator, radiating structure, and sensor assembly, b) controlling activation of the actuator so as to make the radiating structure vibrate, according to a selected setpoint:
taking account of the transfer function measured, and
taking account of the acoustic signal sensed by the sensor in feedback mode.

The taking into account of the aforementioned transfer function makes it possible to precisely control the acoustic effects made by the vibration of the instrument such that it becomes possible to give the vibratory and sound features of a "virtual" instrument that is well known (for example of sonority recognized as being of quality, of "stradivarius" type for a violin) to the real instrument (which for its part is of "standard" quality).

In one embodiment of the method, the activation of the actuator is controlled in hybrid "feedback/feedforward" mode.

In one such embodiment, at step a):

said transfer function is measured in open loop, and from there, the vibratory parameters of the structure may be estimated to calculate the feedback control gains, as will be seen in the example of method illustrated in FIG. 7.

In one embodiment, the selected setpoint comprises a control of at least one sound effect from a change in sound amplitude, an equalization, a delay, a reverberation, a distortion, a phase change, a frequency change, an amplitude modulation, and a combination of said sound effects.

In one such embodiment notably, the feedforward type gains may be adjusted according to the sound effect setpoint, by updating the transfer function measured at step a).

Moreover, the feedback control gains may be updated according to the sound effect setpoint.

Furthermore, a microphone may be provided in order to sense an acoustic pressure in the air close to the radiating structure. The method may then comprise the measurement of a second transfer function of the aforementioned actuator, radiating structure and microphone assembly. Such an embodiment enables the activation of the actuator controlled in feedback/feedforward mode, with in particular a refined estimation of the feedback control gains also according to said second transfer function (illustrated by reference H2 in FIGS. 3 and 6 discussed further).

Thus, a use of the method according to said embodiment may consist of configuring the aforementioned computer means to give the features both vibratory (aforementioned first transfer function) and sound (aforementioned second transfer function) of a selected instrument (virtual) to the real instrument.

Moreover, the processing of sound data may be performed by sample, at a latency preferably lower than one hundred microseconds. This is typically an input/output physical audio latency (before analog-to-digital converter and after the digital-to-analog converter).

In one example of embodiment where the radiating structure comprises a sound box of a string musical instrument, the aforementioned transfer function is measured strings muted.

In one embodiment where the radiating structure comprises a sound box of a string musical instrument, two actuators are provided disposed either side of the bridge bearing the strings.

The aim of the present disclosure is also a computer program comprising instructions for implementing the method above when said program is run by a processor. FIG. 7 discussed further illustrates by way of example a flowchart of a possible algorithm of such a computer program.

The aim of the present disclosure is also a device comprising a processing circuit configured for implementing the method above, as described in detail hereafter.

BRIEF DESCRIPTION OF THE DRAWINGS

Other advantages and features of the disclosure will become apparent upon reading the following detailed description of examples of the embodiment of the disclosure, and upon examination of the appended drawings, wherein.

DETAILED DESCRIPTION

Figure 1:
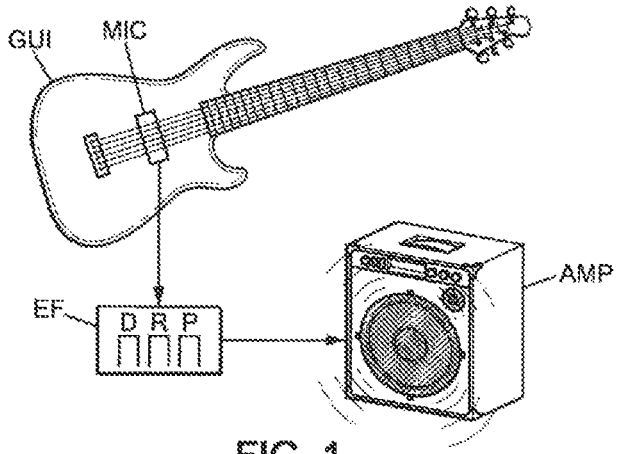
FIG. 1 illustrates the conventional assembly of an instrument connected to an effects pedal, same connected to an amplifier.
Figure 2:
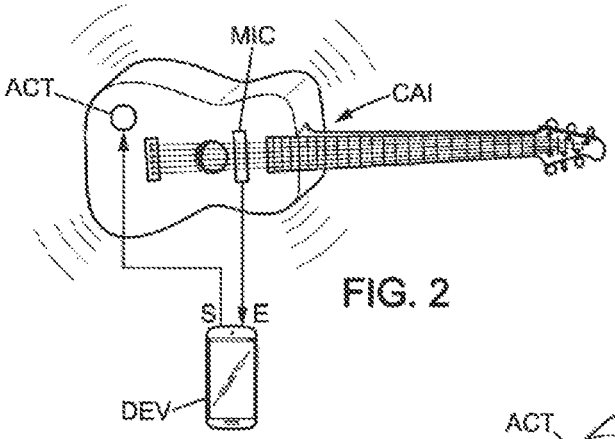
FIG. 2 illustrates an assembly within the meaning of the disclosure of a sensor and of one or more actuators on an instrument connected to a device managing the actuators notably according to a setpoint of a user of the device.
Figure 9:
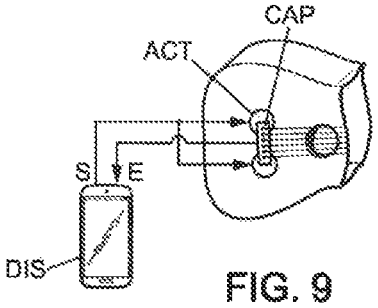
FIG. 9 illustrates an example of advantageous embodiment of equipment for a guitar, connected to a device within the meaning of the disclosure.

As illustrated in FIG. 9, an acoustic guitar equipped with a device within the meaning of the disclosure is provided with:

a piezoelectric sensor CAP under the nut (portion under the bridge bearing the strings), one or more (for example two) electrodynamic actuators ACT mounted here in parallel on each side of the bridge, and a device DIS (connected by the input E thereof to the sensor, and the output S thereof to the actuators).

Figure 8:
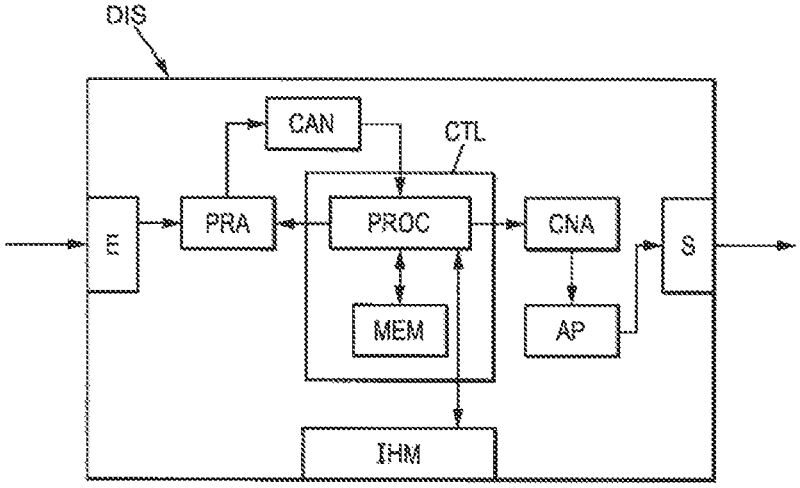
FIG. 8 illustrates an example of device for the implementation of the disclosure.

With reference to FIG. 8 showing in detail the device DIS in one example of embodiment, the device comprises:

a pre-amplifier PRA for the sensor (via the input E of the device), a fast analog-to-digital converter CAN, a microcontroller CTL, a fast digital-to-analog converter CNA and a power amplifier AP exciting the actuators ACT (via the output S of the device).

The physical latency of the processing does not exceed a few microseconds.

Thus, the device DIS operates practically in real time (at very low latency such as, for example, a few microseconds between the input E and the output S). The device DIS comprises a microcontroller or more generally a processing circuit CTL typically comprising:

a memory MEM storing the instruction data of a computer program within the meaning of the disclosure (and optionally other non-permanent, calculation data), and a processor PROC reading the content of the memory MEM in order to run the computer program, thus implementing digital audio processing algorithms performed by sample, said algorithms being informed by an estimation of the properties of the radiating structure, obtained as described hereafter.

Figure 3:
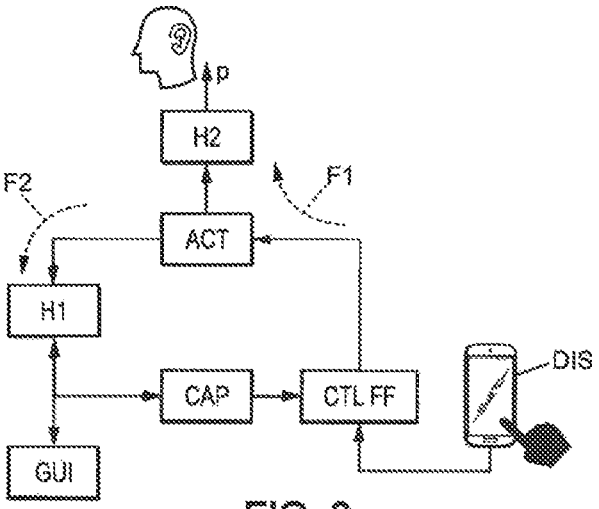
FIG. 3 illustrates the transformation of the timbre of an instrument, here by simple feedforward type control modifying the radiated acoustic pressure p (primary path from the excitation of the string), and in particular to show that the secondary path (from the actuator to the sensor) may induce an instability, in the absence of control of the feedback.
Figure 4:
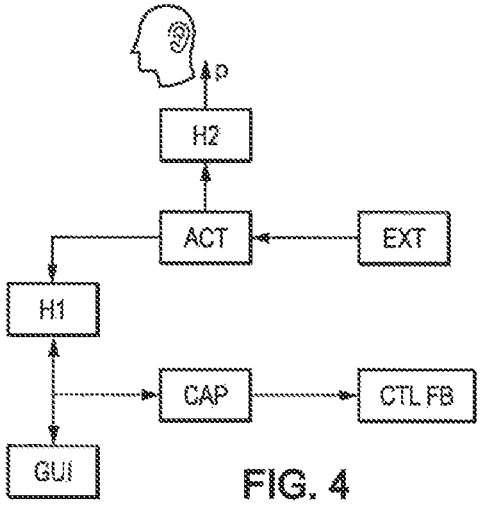
FIG. 4 illustrates an adjustment of a "feedback" (FB) type control following the measurement of the transfer function between the sensor and the actuator in open loop.

The present disclosure proposes a feedback/feedforward (FB/FF) type processing, wherein:

a transfer function H1 between the sensor CAP and the actuators ACT is estimated initially in open loop as illustrated in FIG. 4, an acoustic processing (for example an effect or a combination of effects) is pre-selected by a user via a human-machine interface (IHM) that comprises the device DIS, the controller CTL optionally adjusts the estimated transfer function, according to the programmed effect, when the user plays the instrument, the programmed effect is applied in order to implement the actuators, in feedforward mode (arrow F1 in FIG. 3), subsequently, the vibration that makes the actuators operate on the instrument and notably on the strings is taken into account (arrow F2 in FIG. 3) taking account of the adjusted transfer function, and controlling in particular the signal that the sensor CAP senses (for example providing a control at the pre-amplification PRA by the processor PROC as illustrated in FIG. 8), the sound or the vibration sensed by the sensor CAP is thus adjusted and analyzed in feedback mode in order to apply the desired effect (CTL FF) with the taking into account of the activation of the actuators on the vibration of the strings and more generally of the radiating structure, said vibration being added to the natural playing by the musician and to the desired acoustic effect.

It is further possible to estimate in real time the vibroacoustic transfer function H2 between the actuators and one or more acoustic microphones positioned in any points of the space to measure the pressure p (close to the ears of the musician, the audience, or even an audio pick-up for example by a smartphone integrating the computer means of a device within the meaning of the disclosure). Thus for example, the aforementioned pre-selection of a specific processing for a sound effect selected by the user may be performed statically by an application on smartphone, typically via a wireless connection (Bluetooth for example), or dynamically directly on the instrument (for example with potentiometers as on electrical guitars but to directly adjust the effects and not the volumes).

Thus, the acoustic pressure p presented in FIGS. 3 to 6 may be measured by a microphone (same of the smartphone used as user interface for example). Said measurement may then be used (further the transfer function H1) in the determination of the gains of the feedforward, or even for the determination of gains coupled in feedback/feedforward, for an enhancement of the final rendition, to the ear of the musician.

Figure 6:
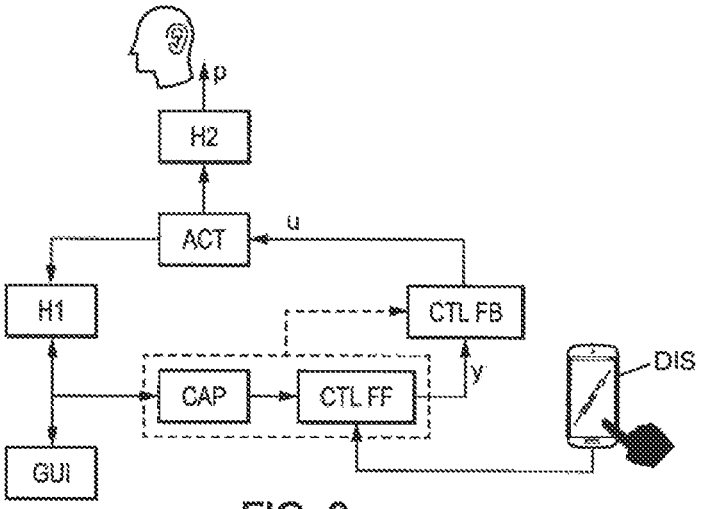
FIG. 6 illustrates a parallel adjustment of the feedback control, updated in order to take account of the new values of the feedforward control imposed by the setpoint of the effect selected by the musician.

It should be noted that feedback control mode is not shown in FIG. 3 illustrating simply "acoustic paths", but rather in FIG. 6 illustrating an implementation of the disclosure.

In one specific embodiment illustrated in FIG. 4, the transfer function H1 between the sensor and the actuators is measured initially strings muted (without the musician playing on the strings). Said transfer function has a series of peaks in the frequency space, as well as an average amplitude per frequency band (nine bands for example). Thus, this is a measurement of the transfer function between actuators and sensors, in open loop, the vibratory properties of the radiating structure then being estimated (frequencies, factors of quality of the resonances, amplitudes at the sensors and at the actuators, and/or other properties). Subsequently, from said measurements, it is deduced the vibration features at the sensor CAP that make it possible to refine the control of the feedback to apply (thanks to the automatic parameter estimation methods described further). The feedback controller is then programmed from said measurements and estimations. As will be seen further, same is further reprogrammed automatically for each new feedforward processing.

Figure 5:
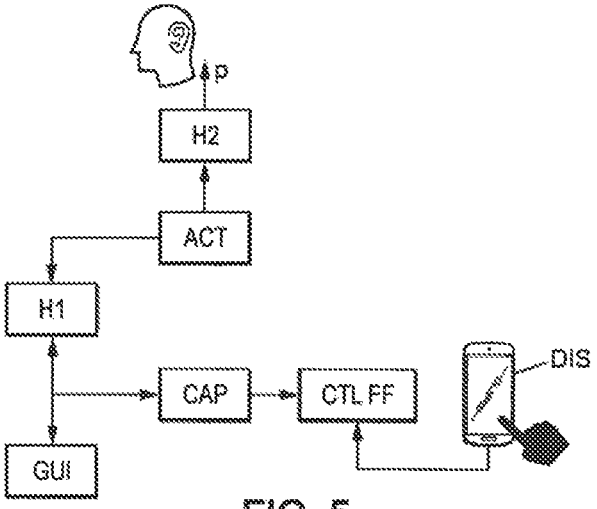
FIG. 5 illustrates an adjustment of a feedforward (FF) type control, according to the effect selected by the musician.

Moreover, with reference now to FIG. 5, when the user starts to select the modifications of the acoustic sound that same desires (aforementioned effects), the feedforward type gains are adjusted. The values of said gains update the transfer function as explained above (since the features of the sound at the sensor will be influenced by the type of effect selected, such as, for example, a delay making the structure vibrate after the attack by the musician), which also updates the gains of the controller by feedback. Thus, perfect taking into account of the modifications selected by the musician is obtained for an optimum restitution of the instrument (taking into account the influence of said modifications on the feedback that is intrinsic to the instrument).

If the guitarist chooses for example to increase the sound level by 6 dB (sound level doubled), the device measures the modifications of the transfer function H1 in feedforward open loop with the signal at the sensor increased by 6 dB. Thus, same estimates the new frequency amplitude values, as well as the deviation thereof with the initial values. Thus, it will be understood that the transfer function is preferably estimated:

for a plurality of frequency bands (typically around ten), and according to a plurality of sound amplitude levels (characterizing for example the level of excitation with the attack by the musician).

The controller adjusts the feedback type gains (related to the increase by 6 dB of each control gain for example) to obtain a stable control. Indeed, if the taking into account of said feedback was not performed, the control would generally be unstable. If the musician again changes the sound level thereof by transforming the feedforward gain, the gain of the feedback is recalculated and applied to the system (device and actuators/sensor).

Thus, it will be understood that the transfer function is estimated dynamically, notably according to the effect or to the combination of effects selected by the user.

If the musician wants the instrument thereof to have the same timbre as another instrument, such as, for example, a guitar of better quality that has been previously analyzed, the band amplitudes of said better guitar are targeted by the feedforward gains, said gains moreover updating the features of the sensor. The frequencies and dampings of the better guitar are then targeted by the feedback type controller on the device integrating said gains, by pole placement of the system in closed loop for example. Without the feedback/feedforward combination, the frequencies and dampings are accessible but not the band amplitudes and instabilities may be generated.

In this case notably, it may be useful to estimate the second transfer function H2 in order to refine the feedback calculation parameters (vibratory but also sound), then using a microphone to sense the acoustic pressure p in the air close to the radiating structure of the instrument (for example, simply by the microphone of a smartphone close by operating the processing of the disclosure). Thus, the instrument may "sound to the ear" of the user like a target instrument selected.

By way of purely indicative and non-limiting example, the instrument/sensor/actuators system comprising the control may be formalized, in a first conventional approach, as follows:

$$dx/dt=Ax(t)+Bu(t)+Gw(t) \quad (1)$$

$$y(t)=Cx(t) \quad (2)$$

$$u(t)=-Kx(t) \quad (3)$$

where x(t) is the state vector of the system (set of displacements and modal velocities for example), u(t), y(t) and w(t) being respectively the control, the measurement and the disturbance, A is the matrix characterizing the radiating structure, B same of the actuators, C same of the sensor, G same of the disturbance and K the gain vector of the controller.

Said system depends on each radiating structure, on the position and the quantity of sensors and actuators, and on the disturbance.

In one specific embodiment, the pick-up is performed using a single piezoelectric sensor (ceramic PZT or PVDF or even MFC for example) below the nut of the bridge of a guitar or at the interface between the strings and the bridge of a violin. Another embodiment may provide multiple sensors separated on the bridge, one at the interface with each string.

The actuation is such that same produces a radiated sound of the quality of a good loudspeaker enclosure whilst making it possible to measure the vibratory features of the box. For this, the position and the quantity of actuators may be determined by optimization on a digital simulation by multi-physical finite elements for example. In one specific embodiment illustrated in FIG. 9, the actuation is carried out at the bridge, using two inertial electrodynamic actuators ACT mounted in parallel on each side of the bridge with a controllable phase difference or mounted to receive a stereo signal.

In the expressions above, the parameters A, B, C and G are estimated for example from digital calculation on the simulation of the complete electromechanical system with the finite-element method. Another approach consists of estimating same experimentally, from the transfer function in open loop between sensor(s) and actuator(s) for A, B and C and an admittance measurement at the bridge with impact hammer or "vibrator" and accelerometer for G. The estimation is then carried out for example with the Rational Fractional Polynomial (RFP) method.

On the other hand, x(t) not being directly accessible (since the measurement only gives y(t)), same is estimated at any moment, for example using state observers, such as the Luenberger observer.

A y/w transfer function of the system may then be written:

$$y/w=C(sld-A)G^{-1} \text{ for the system alone} \quad (4)$$

$$y/w=C(sld-(A-BK))G^{-1} \text{ for the controlled system} \quad (5)$$

The controlled vibration of the radiating structure thus has the dynamic of (A−BK) and plus same of A alone. The vector K is calculated to achieve a certain vibratory target, such as the frequencies and dampings of the resonances. It could, for example, be possible to use pole placement algorithms of (A−BK).

In a second approach presented above with reference to FIGS. 3 to 5, the proposed controller introduces, in addition in the control, the features of the vibration taken into account at the sensor (making it possible to inject a feedforward gain transforming the radiated acoustic pressure p but generating feedback). In this case, in addition to the estimation of A, B, C and G, an average per frequency band of the transfer function H1 (and potentially of the transfer function H2 illustrated in the drawings) is performed. It is possible to select, for example, nine bands (Hz): [20, 100]; [100, 200]; [200, 400]; [400, 800]; [800, 1600]; [1600, 3200]; [3200, 6400]; [6400, 12800]; [12800, 20000]. The modification of each of said bands thus constitutes the target of the feedforward control. Once said control has been determined, the vector C is calculated.

Figures 10A, 10B, 10C:
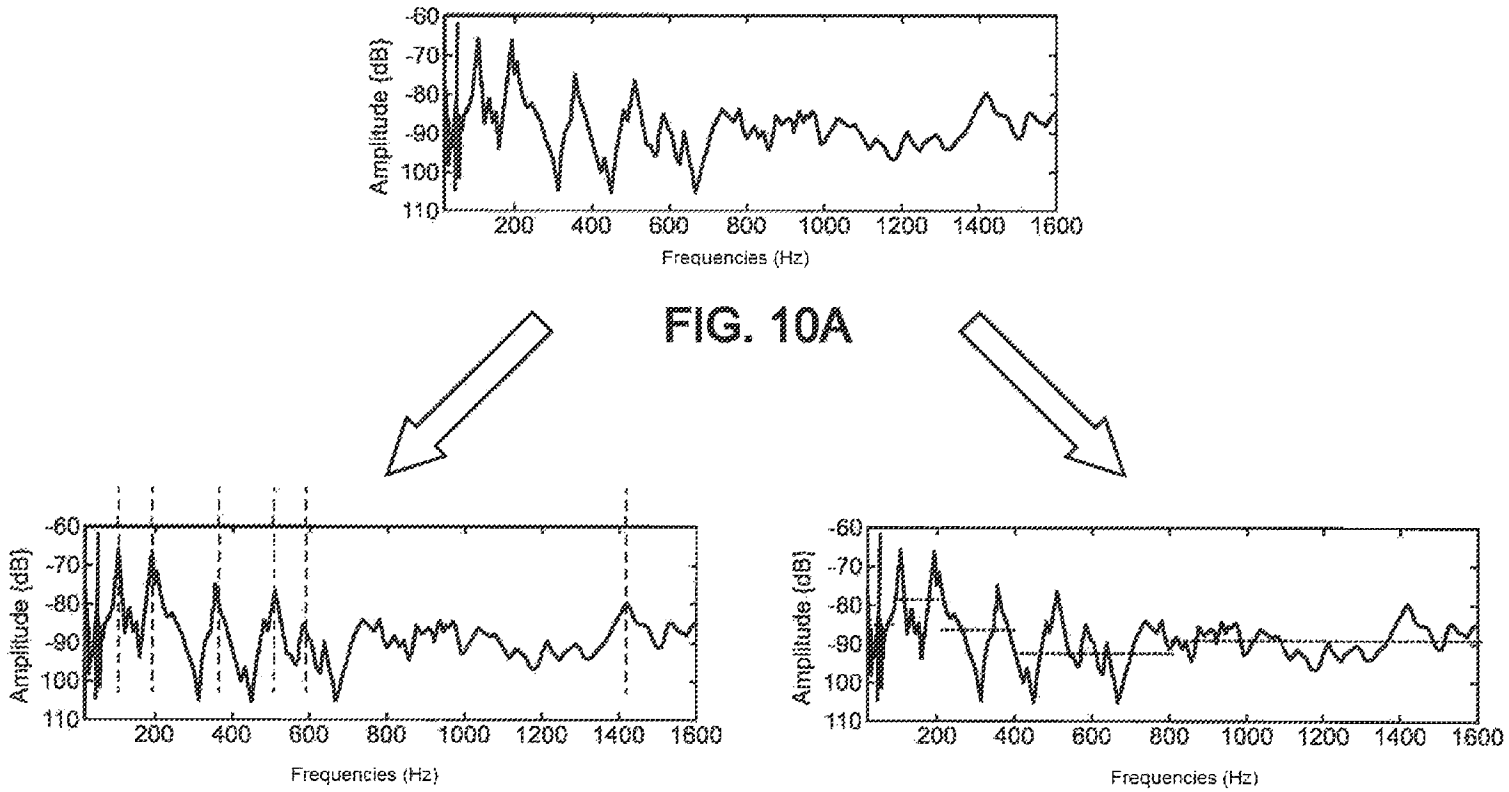
FIGS. 10A, 10B and 10C illustrate the processing operated in one example of embodiment in order to obtain the parameters determined from the aforementioned transfer function H1, in view of the feedforward control.

It is illustrated in FIGS. 10A, 10B and 10C an example for obtaining the parameters A, B, C, K intervening in the equations above. With reference to FIG. 10A, the spectrum (amplitudes/frequencies) of the transfer function H1 between the sensor(s) and the actuator(s) is measured. With reference to FIG. 10B, the frequency detection of isolated amplitude peaks of the transfer function H1 make it possible to obtain the parameters A, B and C. With reference to FIG. 10C, the calculation of the average amplitude per frequency band of the transfer function H1 is also performed in order to obtain the parameter K, further according to the previously estimated parameters A, B and C. It may then indeed be obtained the gains K of the feedback controller, and also per frequency band same of the feedforward controller. Globally, it is thus obtained all of the frequencies, dampings and modal gains, with the band amplitudes.

In the following, the feedback control is calculated differently in relation to the aforementioned first approach, known as "conventional" (in the sense where same could appear immediately).

In said second approach, equations (1) and (2) remain unchanged but equation (3) becomes:

$$u(t)=-Kx(t)+Cx(t) \quad (6)$$

The y/w transfer function of the system is written for the controlled system:

$$y/w=C(sld-(A+BC-BK))G^{-1} \quad (7)$$

The controlled box thus has the dynamic of (A+BC−BK) and more same of (A−BK) with the controller according to the first conventional approach. The vector K is calculated for:

providing the stability for all of the modifications made to the vector C, achieving a given vibratory target by placing, for example, the poles of (A+BC−BK), the frequencies and dampings of the resonances being controlled by the vector K and the band amplitudes being controlled by the matrix C.

Of course, this is an example of embodiment to illustrate the features taken into account at the sensor CAP, as illustrated in FIG. 6, directly for the feedforward control CTL FF, but indirectly also for the feedback control CTL FB and vice-versa. Indeed, the feedforward control is considered here as applying a modification of the vibratory features to the sensor.

Figure 7:
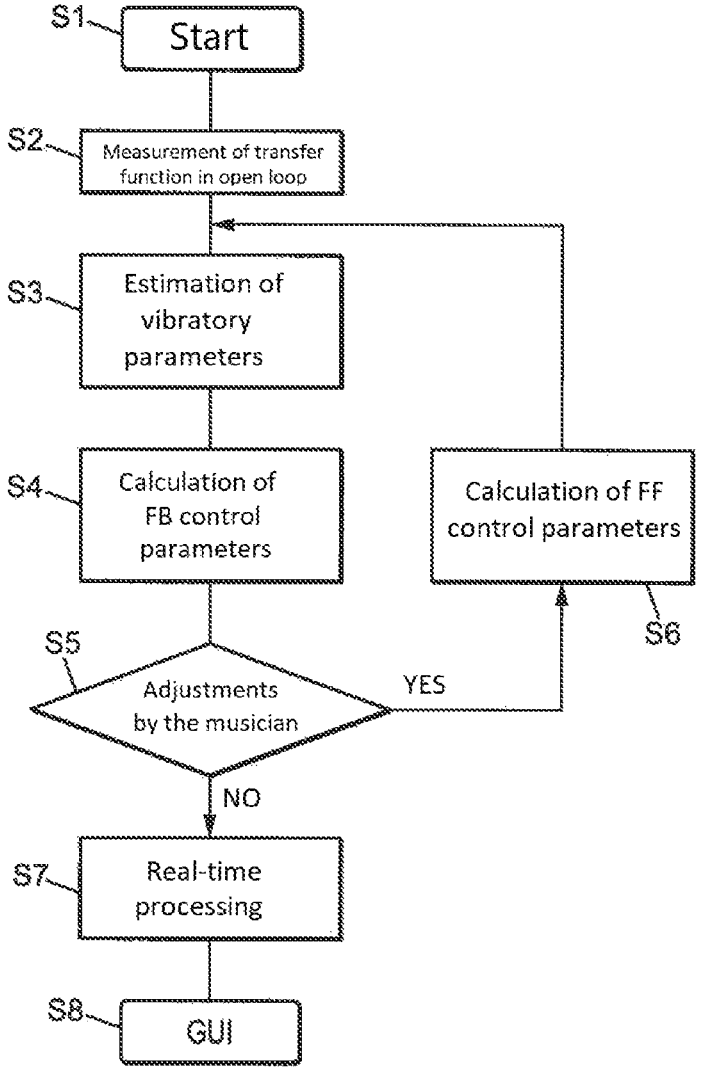
FIG. 7 illustrates a flowchart showing the steps of an example of method within the meaning of the present disclosure.

With reference now to FIG. 7 summarizing an example of succession of steps of a method within the meaning of the disclosure, after a start step S1 aiming, for example, the connection of the device DIS to the instrument/sensor/actuators system, it is measured, in practice, the transfer function H1 in feedforward open loop at step S2, which makes it possible to deduce at step S3 the vibratory parameters of the radiating structure and notably the form of the transfer function H1 and, from there, at step S4 the feedback control parameters. Subsequently, at step S5, the musician may program a sound adjustment and/or specific effect, in which case the parameters of the feedforward control are updated at step S6, as well as the other parameters estimated at steps S3 and S4. Additionally or alternatively, the sound adjustment may be performed automatically, for example, according to the specific attack by the musician, or other. Incidentally, in one possible embodiment, the effect may not be selected directly and restrictively by the musician, but may be programmed dynamically according to the playing by the musician.

Otherwise ("no" arrow as output of the S5 test), the device DIS may operate a real-time processing at step S7 for applying the sound adjustment and/or effects programmed by the user, for a restitution at step S8 by the real instrument.

Thus, the method above takes into account particularly the feedforward control parameters in the estimation of the vibratory parameters and of the calculation of the feedback control gains.

Therefore, the present disclosure makes it possible to drastically reduce the instabilities and to obtain the sound level and more generally the acoustic qualities targeted, thanks to a hybrid feedback/feedforward controller, that is to say that the conventional digital audio effects and the processing of the feedback intrinsic to the instrument are calculated together in order to re-inject the vibration signal into one or more actuators ACT of the radiating structure of the instrument.

The advantages of the technique implemented within the scope of the present disclosure include:

an increase in the sound level and an enhancement of the timbre of the acoustic instrument, the injection of digital audio processing into an acoustic instrument preventing Larsen effect type instabilities, the achievement of target vibratory properties of the radiating structure that are the frequencies, dampings of the resonances and amplitudes per frequency band, in order thus to significantly improve the acoustic qualities of the instrument, a single sensor and a single actuator that may be provided in order to perform all of the transformations.

Of course, the present disclosure is not limited to the embodiment described above by way of example; it extends to other alternative embodiments.

Thus, above is described a radiating structure, of sound box type of a string instrument (guitar type, or even violin or piano). However, the disclosure may also apply to other musical instruments such as, for example, drum shell sets and skins, or even wind instruments. Even more generally, the disclosure may be applied to any radiating structure (with a radiating table or plate possibly but not necessarily coupled to a sound box), or more generally to any electroacoustic system. For example, it may be a loudspeaker enclosure, a computer housing (or even a mobile device (smartphone or portable speaker) diffusing sounds and music) conventionally with a sensor and an actuator controlled within the meaning of the present disclosure.

The invention claimed is:

1. A method implemented by a processing circuit, of processing sound data output by at least one sensor and of activating of at least one actuator of an acoustically radiating structure, the sensor sensing an acoustic signal output by vibration of said radiating structure, said radiating structure bearing said at least one actuator, the actuator being controlled by said processing circuit and being involved in the vibration of said radiating structure, the method comprising:

a) measuring a transfer function of an assembly comprising the actuator, the radiating structure, and the sensor, b) controlling activation of the actuator so as to make the radiating structure vibrate according to a chosen setpoint, in a hybrid feedback/feedforward mode which takes into account:

the acoustic signal sensed by the sensor as a feedback, the chosen setpoint, and the measured transfer function to apply a feedforward to the actuator's activation.

2. The method according to claim 1, wherein, at step a):

said transfer function is measured in open loop, and from there, vibratory parameters of the structure are estimated to calculate feedback control gains.

3. The method according to claim 2, wherein a microphone is further provided to sense an acoustic pressure in the air close to the radiating structure, the method further comprising the measurement of a second transfer function of an assembly comprising the actuator, the radiating structure, and the microphone, and wherein the activation of the actuator is controlled with a refined estimation of the feedback control gains further based on said second transfer function.

4. The method according to claim 1, wherein the chosen setpoint comprises a control of at least one sound effect from a change in sound amplitude, an equalization, a delay, a reverberation, a distortion, a phase change, a frequency change, an amplitude modulation, and a combination of said sound effects.

5. The method according to claim 4, wherein feedforward type gains are adjusted according to the sound effect setpoint, by updating the transfer function measured at step a).

6. The method according to claim 4, wherein feedback control gains are updated according to the sound effect setpoint.

7. The method according to claim 1, wherein said sound data comprises a succession of sound samples and the processing of sound data is performed sample by sample, at a latency lower than one hundred microseconds.

8. The method according to claim 1, wherein, the radiating structure comprises a sound box of a string musical instrument, said transfer function is measured with the strings of the musical instrument being muted.

9. The method according to claim 1, wherein, the radiating structure comprises a sound box of a string musical instrument having a bridge bearing the strings, the bridge having two sides, two actuators are provided disposed at each side of the bridge.

10. The method according to claim 1, wherein, the radiating structure comprises a sound box of a real musical instrument, said computer means are configured to give vibratory and sound features of a chosen musical instrument to said real musical instrument, said chosen instrument being different from said real musical instrument.

11. A non-transitory computer storage medium storing instructions of a computer program causing the implementation of the method according to claim 1, when said instructions are run by a processor.

12. A device comprising a processing circuit configured for implementing the method according to claim 1.

* * * * *